US006787515B2

(12) United States Patent
Foley et al.

(10) Patent No.: US 6,787,515 B2
(45) Date of Patent: Sep. 7, 2004

(54) HARD SURFACE CLEANING COMPOSITION COMPRISING A SOLVENT SYSTEM

(75) Inventors: Peter Robert Foley, Cincinnati, OH (US); Chanchal Kumar Ghosh, West Chester, OH (US); Howard David Hutton, Oregonia, OH (US); Ronald David Turner, Elsmere, KY (US)

(73) Assignee: The Procter & Gamble Company, Cincinnati, OH (US)

( * ) Notice: Subject to any disclaimer, the term of this patent is extended or adjusted under 35 U.S.C. 154(b) by 26 days.

(21) Appl. No.: 10/197,029

(22) Filed: Jul. 17, 2002

(65) Prior Publication Data

US 2003/0130153 A1 Jul. 10, 2003

Related U.S. Application Data

(60) Provisional application No. 60/307,037, filed on Jul. 20, 2001.

(51) Int. Cl.[7] ..... C11D 17/00; C11D 1/75; C11D 3/43

(52) U.S. Cl. ..... 510/506; 510/197; 510/238; 510/505

(58) Field of Search ..... 510/197, 238, 510/505, 506, 446, 424, 340, 298, 435, 428

(56) References Cited

U.S. PATENT DOCUMENTS

| | | | | | |
|---|---|---|---|---|---|
| 4,686,065 | A | * | 8/1987 | Bliznik et al. | 510/197 |
| 5,102,573 | A | | 4/1992 | Han et al. | |
| 5,929,007 | A | * | 7/1999 | Feng | 510/197 |
| 6,221,823 | B1 | * | 4/2001 | Crisanti et al. | 510/238 |
| 6,376,448 | B1 | * | 4/2002 | Colurciello et al. | 510/384 |

FOREIGN PATENT DOCUMENTS

| | | |
|---|---|---|
| WO | WO 94/28108 | 12/1994 |
| WO | WO 97/08301 | 3/1997 |
| WO | WO 97/44427 | 11/1997 |

* cited by examiner

*Primary Examiner*—Gregory Webb
(74) *Attorney, Agent, or Firm*—Kevin L. Waugh

(57) ABSTRACT

A hard-surface cleaning composition for removing cooked-, baked-, or burnt-on food soil from cookware and tableware, the composition comprising a solvent system, wherein said solvent system comprises: a mono-, di- or tri-ethylene glycol phenyl ether or a mixture thereof; and a di- or tri-propylene glycol alkyl ether having an alkyl chain containing of from about 1 to about 5 carbon atoms or a mixture thereof.

20 Claims, No Drawings

HARD SURFACE CLEANING COMPOSITION COMPRISING A SOLVENT SYSTEM

This application claims the benefit of U.S. Provisional Application No. 60/307,037 filed Jul. 20, 2001.

TECHNICAL FIELD

The present invention is in the field of sprayable hard surface cleaning compositions, in particular it relates to products and methods suitable for the removal of cooked-, baked- and burnt-on soils from cookware and tableware.

BACKGROUND OF THE INVENTION

Cooked-, baked- and burnt-on soils are amongst the most severe types of soils to remove from surfaces. Traditionally, the removal of cooked-, baked- and burnt-on soils from cookware and tableware requires soaking the soiled object prior to a mechanical action. Apparently, the automatic dishwashing process alone does not provide a satisfactory removal of cooked-, baked- and burnt-on soils. Manual dishwashing process requires a tremendous rubbing effort to remove cooked-, baked- and burnt-on soils and this can be detrimental to the safety and condition of the cookware/tableware.

The use of cleaning compositions containing solvent for helping in the removal of cooked-, baked- and burnt-on solids is known in the art. For example, U.S. Pat. No. 5,102,573 provides a method for treating hard surfaces soiled with cooked-on, baked-on or dried-on food residues comprising applying a pre-spotting composition to the soiled article. The composition applied comprises surfactant, builder, amine and solvent. U.S. Pat. No. 5,929,007 provides an aqueous hard surface cleaning composition for removing hardened dried or baked-on grease soil deposits. The composition comprises nonionic surfactant, chelating agent, caustic, a glycol ether solvent system, organic amine and anti-redeposition agents. WO-A-94/28108 discloses an aqueous cleaner concentrate composition, that can be diluted to form a more viscous use solution comprising an effective thickening amount of a rod micelle thickener composition, lower alkyl glycol ether solvent and hardness sequestering agent. The application also describes a method of cleaning a food preparation unit having at least one substantially vertical surface having a baked food soil coating. Furthermore, WO-A-97/08301 describes an aqueous hard surface cleaner composition comprising a solvent mixture consisting of a glycol ether acetate and a glycol ether.

The currently known compositions are not fully satisfactory from a consumer viewpoint especially regarding the performance for removal of baked-on, polymerized soil, in particular polymerized grease soils, from metal and other substrates. Indeed, there is still need for an effective cleaning compositions and methods used prior to the washing process of tableware and cookware soiled with cooked-on, baked-on or burnt-on food in order to facilitate the removal of these difficult food residues. Furthermore, it has been found that compositions effective for the removal of cooked-, baked- or burnt-on soils are sometimes perceived as having an unpleasant odour.

Accordingly, it is an objective of the present invention to provide cleaning compositions wherein said compositions provide a good performance on the removal of baked-on, polymerized soil, preferably polymerized grease soil, from metal and other substrates whilst the malodour impression of the composition is reduced.

It has now been found that the above objective can be met by the hard surface cleaning composition comprising a solvent system according to the present invention.

An advantage of the present invention is that the compositions according to the present invention are easy to use and hence reduce the amount of effort required from the user. Indeed, consumers find that the sprayable compositions herein are easy and very convenient to use.

BACKGROUND ART

The following documents are representative of the prior art relevant for the present invention.

WO 97/44427 describes alkaline hard surface cleaning compositions comprising a solvent system consisting of a glycol ether acetate having a solubility in water of below 20% and a glycol ether having a solubility in water of 100%. WO 97/44427 fails to disclose the specific solvent system as described herein.

SUMMARY OF THE INVENTION

The present invention encompasses a hard surface cleaning composition comprising a solvent system, wherein said solvent system comprises : a mono-, di- or tri-ethylene glycol phenyl ether or a mixture thereof; and a di- or tri-propylene glycol alkyl ether having an alkyl chain containing of from 1 to 5 carbon atoms or a mixture thereof.

DETAILED DESCRIPTION OF THE INVENTION

Composition

The composition of the present invention is formulated as a liquid composition. In a preferred embodiment the composition herein is a sprayable composition.

A preferred composition herein is an aqueous composition and therefore, preferably comprises water more preferably in an amount of from about 50% to about 98%, even more preferably of from about 60% to about 97% and most preferably about 70% to about 97% by weight of the total composition.

Preferred compositions of the present invention meet certain rheological and other performance parameter including both the ability to be sprayed and the ability to cling to surfaces. For example, it is desirable that the product sprayed on a vertical stainless steel surface has a flow velocity less than about 1 cm/s, preferably less than about 0.1 cm/s. For this purpose, the product is in the form of a shear thinning fluid having a shear index n (Herschel-Bulkey model) of from about 0 to about 0.8, preferably from about 0.3 to about 0.7, more preferably from about 0.4 to about 0.6. Highly preferred are shear thinning liquids having a shear index of 0.5 or lower. The fluid consistency index, on the other hand, can vary from about 0.1 to about 50 $Pa.s^n$, but is preferably less than about 1 $Pa.s^n$. More preferably, the fluid consistency index is from about 0.20 to about 0.15 $Pa.s^n$. The product preferably has a viscosity from about 0.1 to about 200 Pa s, preferably from about 0.3 to about 20 Pa s as measured with a Brookfield® cylinder viscometer (model LVDII®) using 10 ml sample, a spindle S-31 and a speed of 3 rpm. Specially useful for use herein are compositions having a viscosity greater than about 1 Pa s, preferably from about 2 Pa s to about 4 Pa s at 6 rpm, lower than about 2 Pa s, preferably from about 0.8 Pa s to about 1.2 Pa s at 30 rpm and lower than about 1 Pa s, preferably from about 0.3 Pa s to about 0.5 Pa s at 60 rpm. Rheology is measured under ambient temperature conditions (25° C.).

Suitable thickening agents include inorganic clays (e.g. laponites, aluminium silicate, bentonite, fumed silica). The preferred clay thickening agent can be either naturally occurring or synthetic. Preferred synthetic clays include the synthetic smectite-type clay sold under the trademark Laponite® by Southern Clay Products, Inc. Particularly useful are gel forming grades such as Laponite RD® and sol forming grades such as Laponite RDS®. Natural occurring clays include some smectite and attapulgite clays. Mixtures of clays and polymeric thickeners are also suitable for use herein. Preferred for use herein are synthetic smectite-type clays such as Laponite and other synthetic clays having an average platelet size maximum dimension of less than about 100 nm. Laponite® has a layer structure, which in dispersion in water, is in the form of disc-shaped crystals of about 1 nm thick and about 25 nm diameter. Small platelet size is valuable herein for providing a good sprayability, stability, rheology and cling properties as well as desirable aesthetic.

Preferably, the compositions herein comprise of from about 0.1% to about 5%, preferably of from about 0.5% to about 3% by weight of the total composition of an inorganic clay.

Other types of thickeners, which can be used in this composition, include natural gums, such as xanthan gum, locust bean gum, guar gum, and the like. The cellulosic type thickeners: hydroxyethyl and hydroxymethyl cellulose (ETHOCEL® and METHOCEL® available from Dow Chemical) can also be used. Natural gums seem to influence the size of die droplets when the composition is being sprayed. It has been found that droplets having an average equivalent geometric diameter from about 3 $\mu$m to about 10 $\mu$m, preferably from about 4 $\mu$m to about 7 $\mu$m, as measured using a particle size distribution analyzer (TSI Aerosizer®), help in odor reduction. Preferred natural gum for use herein is xanthan gum. Furthermore, other polymeric thickeners preferably having a molecular weights range of from about 2000 to about 10,000,000 can be used herein.

Preferred herein from the viewpoint of sprayability, cling, stability, and soil penetration performance is a mixture of Laponite and a polymer-type co-thickener, such as a natural gum, as described herein above, a cellulosic type thickeners, as described herein above, other polymeric thickeners, as described herein above, and the like. More preferably, the compositions herein comprise of from about 0.1 to about 5%, preferably of from about 0.5% to about 3% by weight of the total composition of an inorganic clay and of from about 0.05% to about 5%, preferably of from about 0.1% to about 3% by weight of the total composition of a polymer-type co-thickener.

Highly preferred herein from the viewpoint of sprayability, cling, stability, and soil penetration performance is a mixture of Laponite and xanthan gum. Additionally, Laponite/xanthan gum mixtures help the aesthetics of the product and at the same time control the spray droplet size and even further reduce the solvent odour.

The pH of the liquid composition according to the present invention may typically be from 0 to 14.

Preferably, the composition of the invention has a pH, as measured in a 10% solution in distilled water, from at least about 10.5, preferably from about 11 to about 14 and more preferably from about 11.5 to about 13.5. In the case of cleaning of cooked-, baked- or burnt-on soils cleaning performance is related in part to the high pH of the cleaning composition. However, due to the acidic nature of some of the soils, such as for example cooking oil, a reserve of alkalinity is desirable in order to maintain a high pH. On the other hand the reserve alkalinity should not be so high as to risk damaging the skin of the user. Therefore, the compositions of the invention preferably have a reserve alkalinity of less than about 5, more preferably less than about 4 and especially less than about 3. "Reserve alkalinity", as used herein refers to, the ability of a composition to maintain an alkali pH in the presence of acid. This is relative to the ability of a composition to have sufficient alkali in reserve to deal with any added acid while maintaining pH. More specifically, it is defined as the grams of NaOH per 100 cc's, exceeding pH 9.5, in product. The reserve alkalinity for a solution is determined in the following manner.

A Mettler DL77® automatic titrator with a Mettler DG115-SC® glass pH electrode is calibrated using pH 4, 7 and 10 buffers (or buffers spanning the expected pH range). A 1% solution of the composition to be tested is prepared in distilled water. The weight of the sample is noted. The pH of the 1% solution is measured and the solution is titrated down to pH 9.5 using a solution of 0.25N HCL. The reserve alkalinity (RA) is calculated in the following way:

$$RA = \%\ NaOH \times \text{Specific gravity}$$

$$\%\ NaOH = \text{ml HCl} \times \text{Normality of HCl} \times 40 \times 100 / \text{Weight of sample aliquot titrated (g)} \times 1000$$

Solvent System

As an essential element the compositions according to the present invention comprise a solvent system comprising : a mono-, di- or tri-ethylene glycol phenyl ether or a mixture thereof; and a di- or tri-propylene glycol alkyl ether having an alkyl chain containing of from about 1 to about 5 carbon atoms or a mixture thereof.

Ethylene glycol phenyl ether (EPh)

The solvent system herein comprises a mono-, di- or tri-ethylene glycol phenyl ether or a mixture thereof. Suitable, mono-, di- or tri-ethylene glycol phenyl ethers are preferably according to the formula:

$$Ph—O—(C_2H_4O)_n—H$$

wherein n is an integer of from about 1 to about 3. Preferably, n is about 1 and/or about 2, more preferably n is about 1.

A suitable mixture of a mono- and a di-ethylene glycol phenyl ether is commercially available under the trade name Dowanol EPh® from Dow.

Preferably, the compositions herein may comprise of from about 0.1% to about 10%, more preferably from about 1% to about 8%, even more preferably from about 3% to about 8%, still more preferably from about 4% to about 6%, and most preferably about 5% by weight of the total composition of a mono-, di- or tri-ethylene glycol phenyl ether or a mixture thereof.

Di- and Tri-propylene Glycol Alkyl Ethers

Furthermore, the solvent system herein comprises a dipropylene glycol alkyl ether having an alkyl chain containing of from about 1 to about 5 carbon atoms or tripropylene glycol alkyl ether having an alkyl chain containing of from about 1 to about 5 carbon atoms and a mixture thereof. Suitable, di- and tri-propylene glycol alkyl ether having an alkyl chain containing of from about 1 to about 5 carbon atoms are preferably according to the formula:

$$R_1—O—(C_3H_6O)_n—H$$

wherein $R_1$ is an a branched or linear, saturated or unsaturated, substituted or unsubstituted alkyl chain having of from about 1 to about 5 carbon atoms and n is an integer of from about 2 or about 3. In a preferred embodiment of the present invention, $R_1$ is a linear, saturated, unsubstituted alkyl chain. Preferably, $R_1$ is an alkyl chain having 1, 2, 3 or 4 carbon atoms. More preferably, $R_1$ is methyl, propyl or butyl. Even more preferably, $R_1$ is methyl, n-propyl or n-butyl. Still more preferably, $R_1$ is n-propyl. Preferably, n is about 3.

In a preferred embodiment according to the present invention, the solvent system comprises a tripropylene glycol alkyl ether containing of from about 1 to about 5 carbon atoms.

Suitable di- and tripropylene glycol alkyl ethers are commercially available under the trade names Dowanol DPnP® (dipropylene glycol n-propyl ether), Dowanol DPnB® (dipropylene glycol n-butyl ether), Dowanol TPnP® (tripropylene glycol n-propyl ether), Dowanol TPnB® (tripropylene glycol n-butyl ether), Dowanol TPM® (tripropylene glycol methyl ether), from Dow.

Preferably, the compositions herein may comprise of from about 0.1% to about 10%, more preferably from about 1% to about 8%, even more preferably from about 3% to about 8%, still more preferably from about 4% to about 6%, and most preferably about 5% by weight of the total composition of a di- or tri-propylene glycol alkyl ether or a mixture thereof.

In a highly preferred embodiment according to the present invention, the solvent system comprises a mono-ethylene glycol phenyl ether or a mixture of a mono- and a di-ethylene glycol phenyl ether and a tripropylene glycol n-propyl ether.

In another highly preferred embodiment according to the present invention, the solvent system herein comprises said ethylene glycol phenyl ether and said di- or tri-propylene glycol alkyl ether at a weight ratio of from about 99:1 to about 1:99, preferably of from about 66:33 to about 33:66, most preferably of about 50:50.

The present invention is based on the finding that compositions comprising a solvent system as described herein have a good performance on the removal of baked-on, polymerized soil, preferably polymerized grease soil, from metal and other substrates ("cleaning performance") whilst the malodour impression of the composition is reduced ("odour performance"). Indeed, it has been found that the odour performance of the compositions herein is equal or significantly improved, preferably improved, as compared to other compositions comprising a solvent system such as, for example, a 50:50 mixture of diethylene glycol n-butyl ether and propylene glycol n-butyl, whilst showing a similar cleaning performance.

The odour performance or malodour impression ("base odour") of a given composition can be assessed using the following test method:

In an odor performance evaluation a given composition is sprayed 5 times onto a typical household ceramic dish and olfactory graded on a scale of 1–6 as described below. The product is then allowed to soak the dish surface for 5 minutes and a second evaluation is done and again olfactory graded on a scale of 1–6 as described below.

The odour performance of said composition can be assessed by olfactory grading. The olfactory grading may be performed by a group of expert panelists using panel score units (PSU). To assess the odour performance of a given composition a PSU-scale ranging from 0, meaning a poor odour impression (malodour) of the given composition, to 6, meaning a good odour impression of the given composition, can be applied.

The cleaning performance or performance on the removal of baked-on, polymerized soil from metal and other substrates of a given composition can be assessed by measuring the absorbance on polymerized grease soil of said composition. Indeed, cleaning performance is related to the ability of a given composition to solubilize polymerized grease soils. The ability of a given composition to solubilize/dissolve polymerized grease is measured directly by the color change (clear to amber) of the solution formed by the given composition when brought in contact with the polymerized grease soil. The absorbance A on polymerized grease soil of a given composition is measured using the following test method:

Substrates soiled ("soiled surface") with polymerized grease soil are prepared on a stainless steel surface as described herein below. The soiled surface is then lowered into a solution of a given composition and allowed to soak for 1.5 hours at ambient temperature. At this time an aliquot of the polymerized grease soil/given composition solution formed during the soaking is removed and color change quantified by typical visible light Absorbance measure. The use of Light Absorbance measures to quantify the differences in solute concentrations is well known and commonly used in analytical chemistry. Absorbance is defined as the log ratio of incident radiant power $P_o$ to final radiant power P:

$$\text{Absorbance}=A=\log (P_o/P)$$

In this particular test, a Spectronic® Genesys 5 Spectrophotometer manufactured by Milton Roy® was used to determine the Absorbance of solutions at a wavelength of 400 nm. This wavelength is in the visible range, and quantifies the increase in yellow color as polymerized grease is dissolved. Absorbance measures are then compared for the given compositions.

The soiled substrates are prepared as follows: Stainless steel coupons/slides are thoroughly cleaned with the product of the invention and rinsed well with water. The slides are placed in a 50° C. room to facilitate drying, if needed. The coupons/slides are allowed to cool to room temperature (about half an hour). The coupons/slides are weighed. Canola Oil, is sprayed into a small beaker or tri-pour (100 mL beaker, 20–30 mL of Canola Oil). A one inch paintbrush is dipped into the Canola Oil. The soaked brush is then rotated and pressed lightly against the side of the container 4–6 times for each side of the brush to remove excess Canola Oil. A thin layer of Canola Oil is painted onto the surface of the coupon/slide. Each slide is then stroked gently with a dry brush in order to ensure that only a thin coating of Canola Oil is applied (two even strokes should sufficiently remove excess). In this manner 0.1–0.2 g of soil will be applied to the coupon/slide. The coupons/slides are arranged on a perfectly level cookie sheet or oven rack and placed in a preheated oven at 245° C. The slides/coupons are baked for 20 minutes. Coupons/slides are allowed to cool to room temperature (45 minutes). The cool coupons/slides are then weighed.

In a preferred embodiment according to the present invention, the composition herein has an Absorbance on polymerized grease soil after 1.5 hours in contact with the polymerized grease soil of at least about 0.1, preferably at least about 0.2, and most preferably at least about 0.3, when measure using the above described test method.

Optional Ingredients

Soil Swelling Agent

As a highly preferred but optional ingredient, the compositions herein may additionally comprise a soil swelling agent. A soil swelling agent is a substance or composition effective in swelling cooked-, baked- and burnt-on soils as disclosed above. It has been found that a soil swelling agent, when present, further improves the performance of the removal of cooked-, baked- and burnt-on soils of the compositions according to the present invention. Preferred soil swelling agents for use herein include organoamine solvents.

Suitable organoamine solvents to be used herein as soil swelling agents comprise alkanolamines, especially monoethanolamine, beta-aminoalkanols, especially 2-amine-2 methyl-propanol (since it has the lowest molecular weight of any beta-aminoalkanol which has the amine group attached to a tertiary carbon, therefore minimize the reactivity of the amine group) and mixtures thereof.

The soil swelling index (SSI) is a measure of the increased thickness of soil after treatment with a substance or composition in comparison to the soil before treatment with the substance or composition. It is believed, while not being limited by theory that the thickening is caused, at least in part, by hydration or solvation of the soil. Swelling of the soil makes the soil easier to remove with no or minimal application of force, e.g. wiping, rinsing or manual and automatic dishwashing. The measuring of this change of soil thickness gives the SSI.

The amount of substance or composition necessary to provide soil swelling functionality will depend upon the nature of the substance or composition and can be determined by routine experimentation. Other conditions effective for soil swelling such as pH, temperature and treatment time can also be determined by routine experimentation. Preferred herein, however are substances and compositions effective in swelling cooked-, baked- or burnt-on soils such as polymerized grease or carbohydrate soils on glass or metal substrates, whereby after the substance or composition has been in contact with the soil for 45 minutes or less, preferably 30 min or less and more preferably 20 min or less at 20° C., the substance or composition has an SSI at 5% aqueous solution and pH of 12.8 of at least about 15%, preferably at least about 20% more preferably at least about 30% and especially at least about 50%. Preferably also the choice of soil swelling agent is such that the final compositions have an SSI measured as neat liquids under the same treatment time and temperature conditions of at least about 100%, preferably at least about 200% and more preferably at least about 500%. Highly preferred soil swelling agents and final compositions herein meet the SSI requirements on polymerized grease soils according to the procedure set out below.

SSI is determined herein by optical profilometry, using, for example, a Zygo NewView 5030 Scanning White Light Interferometer®. A sample of polymerized grease on a brushed, stainless steel coupon is prepared as described herein below with regard to the measurement of polymerized grease removal index. Optical profilometry is then run on a small droplet of approximately 10 $\mu$m thickness of the grease at the edge of the grease sample. The thickness of the soil droplet before ($S_i$) and after ($S_f$) treatment is measured by image acquisition by means of scanning white light interferometry. The interferometer (Zygo NewView 5030® with 20×Mirau objective) splits incoming light into a beam that goes to an internal reference surface and a beam that goes to the sample. After reflection, the beams recombine inside the interferometer, undergo constructive and destructive interference, and produce a light and dark fringe pattern. The data are recorded using a CCD (charged coupled device) camera and processed by the software of the interferometer using Frequency Domain Analysis. The dimension of the image obtained (in pixels) is then converted in real dimension ($\mu$m or mm). After the thickness of the soil ($S_i$) on the coupon has been measured the coupon is soaked in the invention composition at ambient temperature for a given length of time and the thickness of the soil ($S_f$) is measured repeating the procedure set out above. If necessary, the procedure is replicated over a sufficient member of droplets and samples to provide statistical significance.

The SSI is calculated in the following manner:

$$SSI=[(S_f-S_i)/S_i]\times 100$$

In a preferred embodiment herein, the compositions herein may comprise up to about 10%, preferably of from about 2% to about 8%, more preferably of from about 3% to about 7% and most preferably of from about 4% to about 6% by weight of the total composition of a soil swelling agent.

Spreading Auxiliary

The compositions herein preferably also include a spreading auxiliary. The function of the spreading auxiliary is to reduce the interfacial tension between the soil swelling agent and soil, thereby increasing the wettability of soils by the soil swelling agents. The spreading auxiliary when added to the compositions herein containing soil swelling agents leads to a lowering in the surface tension of the compositions, preferred spreading auxiliaries being those which lower the surface tension below that of the auxiliary itself. It has been found that a spreading auxiliary, when present, further improves the performance of the removal of cooked-, baked- and burnt-on soils of the compositions according to the present invention. Especially useful are spreading auxiliaries able to render a surface tension below about 26 mN/m, preferably below about 24.5 mN/m and more preferably below about 24 mN/m, and especially below about 23.5 mN/m and a pH, as measured in a 10% solution in distilled water, of at least 10.5. Surface tensions are measured herein at 25° C.

Without wishing to be bound by the theory, it is believed that the soil swelling agent penetrates and hydrates the soils. The spreading auxiliary facilitates the interfacial process between the soil swelling agent and the soil and aids swelling of the soil. The soil penetration and swelling is believed to weaken the binding forces between soil and substrate. The resulting compositions are particularly effective in removing soils of a polymerized baked-on nature from metallic substrates.

Thus in a preferred embodiment, the composition herein comprises a polymerized grease swelling agent and a spreading auxiliary and has a liquid surface tension of less than about 26 mN/m, preferably less than about 24.5 mN/m and more preferably less than about 24 mN/m and a pH, as measured in a 10% solution in distilled water, of at least 10.5.

Spreading auxiliaries for use herein can be selected generally from wetting agents and mixtures thereof. In preferred embodiments the liquid surface tension of the spreading auxiliary is less than about 30 mN/m, preferably less than about 28 mN/m, more preferably less than about 26 mN/m and more preferably less than about 24.5 mN/m.

Wetting agents suitable for use as spreading auxiliaries herein are surfactants and include anionic, amphoteric, zwitterionic, nonionic and semi-polar surfactants. Preferred nonionic surfactants include silicone surfactants, such as Silwet® copolymers, preferred Silwet® copolymers include Silwet L-8610®, Silwet L-8600®, Silwet L-77®, Silwet L-7657®, Silwet L-7650®, Silwet L-7607®, Silwet L-7604®, Silwet L-7600®, Silwet L-7280® and mixtures thereof. Preferred for use herein is Silwet L-77®.

Other suitable wetting agents include organo amine surfactants, for example amine oxide surfactants, and silicone surfactants. Preferably, the amine oxide contains an average of from 12 to 18 carbon atoms in the alkyl moiety, highly preferred herein being dodecyl dimethyl amine oxide, tetradecyl dimethyl amine oxide, hexadecyl dimethyl amine oxide and mixtures thereof.

Surfactants

As an optional ingredient, the compositions here in additionally comprise a surfactant in addition to the surfactants used as wetting agents as described above, when present. The addition of surfactant selected from anionic, amphoteric, zwitterionic, nonionic and semi-polar surfactants and mixtures thereof, to the composition of the invention aids the cleaning process and also helps to care for the skin of the user. Preferably the level of surfactant is from about 0.05 to about 10%, more preferably from about 0.09 to about 5% and more preferably from 0.1 to 2%. A preferred surfactant for use herein is an amine oxide surfactant.

In the compositions herein the surfactant is preferably foamable in direct application. Surfactants suitable herein include anionic surfactants such as alkyl sulfates, alkyl ether sulfates, alkyl benzene sulfonates, alkyl glyceryl sulfonates, alkyl and alkenyl sulphonates, alkyl ethoxy carboxylates, N-acyl sarcosinates, N-acyl taurates and alkyl succinates and sulfosuccinates, wherein the alkyl, alkenyl or acyl moiety is $C_5$–$C_{20}$, preferably $C_{10}$–$C_{18}$ linear or branched; cationic surfactants such as chlorine esters (U.S. Pat. Nos. 4,228,042, 4,239,660, and 4,260,529) and mono $C_6$–$C_{16}$ N-alkyl or alkenyl ammonium surfactants wherein the remaining N positions are substituted by methyl, hydroxyethyl or hydroxypropyl groups; low and high cloud point nonionic surfactants and mixtures thereof including nonionic alkoxylated surfactants (especially ethoxylates derived from $C_6$–$C_{18}$ primary alcohols), ethoxylated-propoxylated alcohols (e.g., Olin Corporation's Poly-Tergent® SLF18), epoxy-capped poly(oxyalkylated) alcohols (e.g., Olin Corporation's Poly-Tergent® SLF18B—see WO-A-94/22800), ether-capped poly(oxyalkylated) alcohol surfactants, and block polyoxyethylene-polyoxypropylene polymeric compounds such as PLURONIC®, REVERSED PLURONIC®, and TETRONIC® by the BASF-Wyandotte Corp., Wyandotte, Mich.; amphoteric surfactants such as the $C_{12}$–$C_{20}$ alkyl amine oxides (preferred amine oxides for use herein include lauryldimethyl amine oxide and hexadecyl dimethyl amine oxide), and alkyl amphocarboxylic surfactants such as Miranol™ C2M; and zwitterionic surfactants such as the betaines and sultaines; and mixtures thereof. Surfactants suitable herein are disclosed, for example, in U.S. Pat. Nos. 3,929,678, and 4,259,217, EP-A-0414 549, WO-A-93/08876 and WO-A-93/08874.

Furthermore, the compositions herein may comprise a low cloud point non-ionic surfactant and suds suppresser.

The suds suppressers suitable for use herein include nonionic surfactants having a low cloud point. "Cloud point", as used herein, is a well known property of nonionic surfactants which is the result of the surfactant becoming less soluble with increasing temperature, the temperature at which the appearance of a second phase is observable is referred to as the "cloud point" (See Kirk Othmer, pp. 360–362). As used herein, a "low cloud point" nonionic surfactant is defined as a nonionic surfactant system ingredient having a cloud point of less than 30° C., preferably less than about 20° C., and even more preferably less than about 10° C., and most preferably less than about 7.5° C. Typical low cloud point nonionic surfactants include nonionic alkoxylated surfactants, especially ethoxylates derived from primary alcohol, and polyoxypropylene/polyoxyethylene/polyoxypropylene (PO/EO/PO) reverse block polymers. In addition, such low cloud point nonionic surfactants include, for example, ethoxylated-propoxylated alcohol (e.g., Olin Corporation's Poly-Tergent® SLF18) and epoxy-capped poly(oxyalkylated) alcohols (e.g., Olin Corporation's Poly-Tergent® SLF18B series of nonionics, as described, for example, in U.S. Pat. No. 5,576,281).

Preferred low cloud point surfactants are the ether-capped poly(oxyalkylated) suds suppresser having the formula:

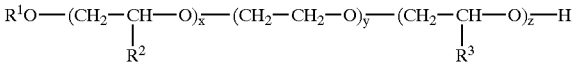

wherein $R^1$ is a linear, alkyl hydrocarbon having an average of from about 7 to about 12 carbon atoms, $R^2$ is a linear, alkyl hydrocarbon of about 1 to about 4 carbon atoms, $R^3$ is a linear, alkyl hydrocarbon of about 1 to about 4 carbon atoms, x is an integer of about 1 to about 6, y is an integer of about 4 to about 15, and z is an integer of about 4 to about 25.

Other low cloud point nonionic surfactants are the ether-capped poly(oxyalkylated) having the formula:

$$R_I O(R_{II}O)_n CH(CH_3)OR_{III}$$

wherein, $R_I$ is selected from the group consisting of linear or branched, saturated or unsaturated, substituted or unsubstituted, aliphatic or aromatic hydrocarbon radicals having from about 7 to about 12 carbon atoms; $R_{II}$ may be the same or different, and is independently selected from the group consisting of branched or linear $C_2$ to $C_7$ alkylene in any given molecule; n is a number from 1 to about 30; and $R_{III}$ is selected from the group consisting of:

(i) a 4 to 8 membered substituted, or unsubstituted heterocyclic ring containing from 1 to 3 hetero atoms; and (ii) linear or branched, saturated or unsaturated, substituted or unsubstituted, cyclic or acyclic, aliphatic or aromatic hydrocarbon radicals having from about 1 to about 30 carbon atoms;

(b) provided that when $R^2$ is (ii) then either: (A) at least one of $R^1$ is other than $C_2$ to $C_3$ alkylene; or (B) $R^2$ has from 6 to 30 carbon atoms, and with the further proviso that when $R^2$ has from 8 to 18 carbon atoms, R is other than $C_1$ to $C_5$ alkyl.

Surfactants are typically present at a level of from about 0.2% to about 30% by weight, more preferably from about 0.5% to about 10% by weight, most preferably from about 1% to about 5% by weight of composition. Preferred surfactants for use herein are low foaming and include low cloud point nonionic surfactants and mixtures of higher foaming surfactants with low cloud point nonionic surfactants, which act as suds suppresser therefore.

Perfume Ingredient

The composition herein may additionally comprise an odour-masking perfume or perfume base. In general terms, the odour-masking perfume or perfume base comprises a mixture of volatile and non-volatile perfume materials wherein the level of non-volatile perfume materials (boiling point above 250° C. at 1 atmosphere pressure) is preferably greater than about 20% by weight and preferably lies in the range from about 25% to about 65%, more preferably from about 35% to about 55% by weight. Preferably, the perfume or perfume base comprises at least 0.001% by weight of an ionone or mixture of ionones inclusive of alpha, beta and gamma ionones. Certain flowers (e.g., mimosa, violet, iris) and certain roots (e.g., orris) contain varying levels of ionones that can be used in the perfume formulations herein either in their natural forms or in specialty accords in amounts sufficient to provide the required level of ionones. Preferred ionones are selected from gamma-Methyl lonone, Alvanone extra, Irisia Base, naturally occurring ionone materials obtained, for example, from mimosa, violet, iris and orris, and mixtures thereof. Preferably, the composition herein comprises naturally occurring ionone materials. The perfume or perfume base may additionally comprise a musk. The musk preferably has a boiling point of more than about 250° C. Preferred musks are selected from Exaltolide Total, Habonolide, Galaxolide and mixtures thereof. The masking perfume or perfume base can further comprise a high volatile perfume component or mixture of components having a boiling point of less than about 250° C. Preferred high volatile perfume components are selected from decyl aldehyde, benzaldehyde, cis-3-hexenyl acetate, allyl amyl glycolate, dihydromycenol and mixtures thereof.

The composition can additionally comprise a blooming perfume composition. A blooming perfume composition is one that comprises blooming perfume ingredients. A blooming perfume ingredient may be characterized by its boiling point and its octanol/water partition coefficient (P). Boiling point as used herein is measured under normal standard pressure of 760 mmHg. The boiling points of many perfume ingredients, at standard 760 mm Hg are given in, e.g., "Perfume and Flavor Chemicals (Aroma Chemicals)," Steffen Arctander, published by the author, 1969.

The octanol/water partition coefficient of a perfume ingredient is the ratio between its equilibrium concentrations in octanol and in water. The partition coefficients of the preferred perfume ingredients for use herein may be more conveniently given in the form of their logarithm to the base 10, logP. The logP values of many perfume ingredients have been reported; for example, the Pomona92 database, available from Daylight Chemical Information Systems, Inc. (Daylight CIS), Irvine, California, contains many, along with citations to the original literature. However, the logP values are most conveniently calculated by the "CLOGP" program, also available from Daylight CIS®. This program also lists experimental logP values when they are available in the Pomona92 database. The "calculated logP" (ClogP) is determined by the fragment approach of Hansch and Leo (cf., A. Leo, in Comprehensive Medicinal Chemistry, Vol. 4, C. Hansch, P. G. Sammens, J. B. Taylor and C. A. Ramsden, Eds., p. 295, Pergamon Press, 1990). The fragment approach is based on the chemical structure of each perfume ingredient, and takes into account the numbers and types of atoms, the atom connectivity, and chemical bonding. The ClogP values, which are the most reliable and widely used estimates for this physicochemical property, are preferably used instead of the experimental logP values in the selection of perfume ingredients which are useful herein.

The blooming perfume composition herein used comprises one or more perfume ingredients selected from two groups of perfumes. The first perfume group is characterised by having boiling point of 250° C. or less and ClogP of 3.0 or less. More preferably ingredients of the first perfume group have boiling point of 240° C. or less, most preferably 235° C. or less and a ClogP value of 2.5 or less. The first group of perfume ingredients is preferably present at a level of at least about 7.5%, more preferably at least about 15% and most preferably about at least 25% by weight of the blooming perfume composition.

The second perfume group is characterised by having boiling point of 250° C. or less and ClogP of greater than 3.0. More preferably ingredients of the second perfume group have boiling point of 240° C. or less, most preferably 235° C. or less and a ClogP value of greater than 3.2. The second perfume group is preferably present at a level of at least about 20%, preferably at least about 35% and most preferably at least about 40% by weight of the blooming perfume composition.

The blooming perfume composition comprises at least one perfume from the first group of perfume ingredients and at least one perfume from the second group of perfume ingredients. More preferably the blooming perfume composition comprises a plurality of ingredients chosen from the first group of perfume ingredients and a plurality of ingredients chosen from the second group of perfume ingredients.

In addition to the above, it is also desirable that the blooming perfume composition comprises at least one perfume ingredient selected from either the first and/or second group of perfume ingredients which is present in an amount of at least 7% by weight of the blooming perfume composition, preferably at least 8.5% of the perfume composition, and most preferably, at least 10% of the perfume composition.

Preferred compositions for use herein have a weight ratio of the odour masking perfume or perfume base to the blooming perfume from about 10:1 to about 1:10, preferably from about 4:1 to about 1:4 and more preferably from about 3:1 to about 1:2. The overall odour-masking blooming perfume composition preferably comprises from about 0.5% to about 40%, preferably from about 2% to about 35%, more preferably from about 5% to about 30%, more preferably from about 7% to about 20% by weight of the overall composition of ionone or mixtures thereof.

The composition can also comprise an odour-masking blooming perfume composition comprising:

a) at least 2%, preferably at least 5% and more preferably at least 8% by weight thereof of one or more first perfume ingredients having boiling point of 250° C. or less, preferably 240° C. or less, most preferably 235° C. or less and ClogP of 3.0 or less, more preferably 2.5 or less;

b) at least 30%, preferably at least 40% and more preferably at least 50% by weight thereof of one or more second perfume ingredients having boiling point of 250° C. or less, preferably 240° C. or less, most preferably 235° C. or less and Clog P of greater than 3.0, more preferably greater than 3.2; and c) at least about 10%, preferably at least 15% and more preferably at least 20% by weight thereof of non-volatile perfume materials having a boiling point above 250° C., preferably above 260° C. and most preferably above 265° C. at 1 atmosphere pressure, and which preferably comprises an ionone or a mixture of ionones and/or a musk or mixture of musks;

preferably the perfume composition comprises at least one individual first or second perfume ingredient present in an amount of at least 2%, preferably at least 4% by weight of the composition.

The composition can additionally comprise a cyclodextrin, in order to help control solvent malodour. Cyclodextrins suitable for use herein are those capable of selectively absorbing solvent malodour causing molecules without detrimentally affecting the odour masking or perfume molecules. Compositions for use herein comprise from about 0.1 to about 3%, preferably from about 0.5 to about 2% of cyclodextrin by weight of the composition. As used herein, the term "cyclodextrin" includes any of the known cyclodextrins such as unsubstituted cyclodextrins containing from six to twelve glucose units, especially, alpha-cyclodextrin, beta-cyclodextrin, gamma-cyclodextrin and/or their derivatives and/or mixtures thereof. The alpha-cyclodextrin consists of six glucose units, the beta-cyclodextrin consists of seven glucose units, and the gamma-cyclodextrin consists of eight glucose units arranged in a donut-shaped ring. The specific coupling and conformation of the glucose units give the cyclodextrins a rigid, conical molecular structure with a hollow interior of a specific volume. The "lining" of the internal cavity is formed by hydrogen atoms and glycosidic bridging oxygen atoms, therefore this surface is fairly hydrophobic. The unique shape and physical-chemical property of the cavity enable the cyclodextrin molecules to absorb (form inclusion complexes with) organic molecules or parts of organic molecules, which can fit into the cavity. Malodour molecules can fit into the cavity.

Preferred cyclodextrins are highly water-soluble such as, alpha-cyclodextrin and derivatives thereof, gamma-cyclodextrin and derivatives thereof, derivatised beta-cyclodextrins, and/or mixtures thereof. The derivatives of cyclodextrin consist mainly of molecules wherein some of the OH groups are converted to OR groups. Cyclodextrin derivatives include, e.g., those with short chain alkyl groups such as methylated cyclodextrins, and ethylated cyclodextrins, wherein R is a methyl or an ethyl group; those with hydroxyalkyl substituted groups, such as hydroxypropyl cyclodextrins and/or hydroxyethyl cyclodextrins, wherein R is a $—CH_2—CH(OH)—CH_3$ or a $—CH_2CH_2—OH$ group; branched cyclodextrins such as maltose-bonded cyclodextrins; cationic cyclodextrins such as those containing 2-hydroxy-3 (dimethylamino) propyl ether, wherein R is $CH_2—CH(OH)—CH_2—N(CH_3)_2$ which is cationic at low pH; quaternary ammonium, e.g., 2-hydroxy-3-(trimethylammonio)propyl ether chloride groups, wherein R is $CH_2—CH(OH)—CH_2—N^+(CH_3)_3Cl^-$; anionic cyclodextrins such as carboxymethyl cyclodextrins, cyclodextrin sulfates, and cyclodextrin succinylates; amphoteric cyclodextrins such as carboxymethyl/quaternary ammonium cyclodextrins; cyclodextrins wherein at least one glucopyranose unit has a 3-6-anhydro-cyclomalto structure, e.g., the mono-3-6-anhydrocyclodextrins, as disclosed in "Optimal Performances with Minimal Chemical Modification of Cyclodextrins", F. Diedaini-Pilard and B. Perly, The 7th International Cyclodextrin Symposium Abstracts, April 1994, p. 49, and mixtures thereof. Other cyclodextrin derivatives are disclosed in U.S. Pat. Nos. 3,426,011, 3,453,257, 3,453,258, 3,453,259, 3,453,260, 3,459,731, 3,553,191, 3,565,887, 4,535,152, 4,616,008, 4,678,598, 4,638,058, and 4,746,734.

Highly water-soluble cyclodextrins are those having water solubility of at least about 10 g in 100 ml of water at room temperature, preferably at least about 20 g in 100 ml of water, more preferably at least about 25 g in 100 ml of water at room temperature. Examples of preferred water-soluble cyclodextrin derivatives suitable for use herein are hydroxypropyl alpha-cyclodextrin, methylated alpha-cyclodextrin, methylated beta-cyclodextrin, hydroxyethyl beta-cyclodextrin, and hydroxypropyl beta-cyclodextrin. Hydroxyalkyl cyclodextrin derivatives preferably have a degree of substitution of from about 1 to about 14, more preferably from about 1.5 to about 7, wherein the total number of OR groups per cyclodextrin is defined as the degree of substitution. Methylated cyclodextrin derivatives typically have a degree of substitution of from about 1 to about 18, preferably from about 3 to about 16. A known methylated beta-cyclodextrin is heptakis-2,6-di-O-methyl-β-cyclodextrin, commonly known as DIMEB, in which each glucose unit has about 2 methyl groups with a degree of substitution of about 14. A preferred, more commercially available methylated beta-cyclodextrin is a randomly methylated beta-cyclodextrin having a degree of substitution of about 12.6. The preferred cyclodextrins are available, e.g., from American Maize-Products Company and Wacker Chemicals (USA), Inc. Hydroxypropyl beta-cyclodextrin, available from Cerestar, is preferred for use herein.

Builder

As another optional ingredient, the compositions herein may comprise a builder.

Builders suitable for use in cleaning compositions herein include water-soluble builders such as citrates, carbonates and polyphosphates e.g. sodium tripolyphosphate and sodium tripolyphosphate hexahydrate, potassium tripolyphosphate and mixed sodium and potassium tripolyphosphate salts; and partially water-soluble or insoluble builders such as crystalline layered silicates (EP-A-0164514 and EP-A-0293640) and aluminosilicates inclusive of Zeolites A, B, P, X, HS and MAP. The builder is typically present at a level of from about 1% to about 80% by weight, preferably from about 10% to about 70% by weight, most preferably from about 20% to about 60% by weight of composition.

Preferably compositions for use herein comprise silicate in order to prevent damage to aluminium and some painted surfaces. Amorphous sodium silicates having an $SiO_2$:$Na_2O$ ratio of from 1.8 to 3.0, preferably from 1.8 to 2.4, most preferably 2.0 can also be used herein although highly preferred from the viewpoint of long term storage stability are compositions containing less than about 22%, preferably less than about 15% total (amorphous and crystalline) silicate.

Other Optional Ingredients

Other suitable components herein include organic polymers having dispersant, anti-redeposition, soil release or other detergency properties invention in levels of from about 0.1% to about 30%, preferably from about 0.5% to about 15%, most preferably from about 1% to about 10% by weight of composition. Preferred anti-redeposition polymers herein include acrylic acid containing polymers such as Sokalan PA30®, PA20®, PA15®, PA10® and Sokalan CP10® (BASF GmbH), Acusol 45N®, 480N®, 460N® (Rohm and Haas), acrylic acid/maleic acid copolymers such as Sokalan CP5® and acrylic/methacrylic copolymers. Preferred soil release polymers herein include alkyl and hydroxyalkyl celluloses (U.S. Pat. No. 4,000,093), polyoxyethylenes, polyoxypropylenes and copolymers thereof, and nonionic and anionic polymers based on terephthalate esters of ethylene glycol, propylene glycol and mixtures thereof.

Heavy metal sequestrants and crystal growth inhibitors are suitable for use herein in levels generally from about 0.005% to about 20%, preferably from about 0.1% to about 10%, more preferably from about 0.25% to about 7.5% and most preferably from about 0.5% to about 5% by weight of composition, for example diethylenetriamine penta (methylene phosphonate), ethylenediamine tetra(methylene phosphonate) hexamethylenediamine tetra(methylene phosphonate), ethylene diphosphonate, hydroxy-ethylene-1, 1-diphosphonate, nitrilotriacetate, ethylenediaminotetracetate, ethylenediamine-N,N'-disuccinate in their salt and free acid forms.

The compositions herein can contain a corrosion inhibitor such as organic silver coating agents in levels of from about 0.05% to about 10%, preferably from about 0.1% to about 5% by weight of composition (especially paraffins such as Winog 70 sold by Wintershall, Salzbergen, Germany), nitrogen-containing corrosion inhibitor compounds (for example benzotriazole and benzimidazole—see GB-A-1137741) and Mn(II) compounds, particularly Mn(II) salts of organic ligands in levels of from about 0.005% to about 5%, preferably from about 0.01% to about 1%, more preferably from about 0.02% to about 0.4% by weight of the composition.

Other suitable components herein include colorants, water-soluble bismuth compounds such as bismuth acetate and bismuth citrate at levels of from about 0.01% to about 5%, enzyme stabilizers such as calcium ion, boric acid, propylene glycol and chlorine bleach scavengers at levels of from about 0.01% to about 6%, lime soap dispersants (see WO-A-93/08877), suds suppressors (see WO-93/08876 and EP-A-0705324), polymeric dye transfer inhibiting agents, optical brighteners, perfumes, fillers and clay.

Liquid detergent compositions can contain water and other volatile solvents as carriers. Low quantities of low molecular weight primary or secondary alcohols such as methanol, ethanol, propanol and isopropanol can be used in the liquid detergent of the present invention. Other suitable carrier solvents used in low quantities includes glycerol, propylene glycol, ethylene glycol, 1,2-propanediol, sorbitol and mixtures thereof.

Process of Cleaning a Hard Surface

The compositions of the present invention are especially useful in direct application for pre-treatment of cookware or tableware soiled with cooked-, baked- or burnt-on residues (or any other highly dehydrated soils), preferably grease soils. The compositions are preferably applied to the soiled substrates in the form for example of a spray or foam prior to automatic dishwashing, manual dishwashing, rinsing or wiping. The pre-treated cookware or tableware can feel very slippery and as a consequence difficult to handle during and after the rinsing process. This can be overcome using divalent cations such as magnesium and calcium salts, especially suitable for use herein is magnesium chloride. The addition of from about 0.01% to about 5%, preferably from about 0.1% to about 3% and more preferably from about 0.4% to about 2% (by weight) of magnesium salts eliminates the slippery properties of the cookware or tableware surface without negatively impacting the stability of physical properties of the pre-treatment composition. The compositions of the invention can also be used as automatic dishwashing detergent compositions or as a component thereof.

In a method aspect, the invention provides a method of removing cooked-, baked- or burnt-on soils from cookware and tableware comprising treating the cookware/tableware with the hard surface cleaning composition of the invention. There is also provided a method of removing cooked-, baked- or burnt-on polymerized grease soils or carbohydrate soils from metallic cookware and tableware comprising treating the cookware/tableware with the hard surface cleaning of the present invention. Preferred methods comprise the step of pre-treating the cookware/tableware with the composition of the invention prior to manual or automatic dishwashing. If desired the process of removing of cooked-, burnt- and baked-on soils can be facilitated if the soiled substrate is covered with cling film after the cleaning composition of the invention has been applied in order to allow swelling of the soil to take place. Preferably, the cling film is left in place for a period of about 1 hour or more, preferably for about 6 hours or more.

There is also provided a hard surface cleaning product comprising the hard surface cleaning composition of the invention and a spray dispenser. The physical properties of the composition and the geometrical characteristic of the spray dispenser in combination are preferably such as to provide spray droplets with an average equivalent geometric diameter from about 3 $\mu$m to about 10 $\mu$m, preferably from about 4 $\mu$m to about 7 $\mu$m, as measured using a TSI Aerosizer®, such droplet size range being optimum from the viewpoint of odour impression and reduced malodour characteristics. Suitable spray dispensers include hand pump (sometimes referred to as "trigger") devices, pressurized can devices, electrostatic spray devices, etc.

The present invention further encompasses the use of a solvent system in a hard surface cleaning composition, wherein said solvent system comprises : a mono, di or tri-ethylene glycol phenyl ether or a mixture thereof; and a di- or tri-propylene glycol alkyl ether having an alkyl chain containing of from about 1 to about 5 carbon atoms or a mixture thereof, wherein a cooked-, baked-, or burnt-on food soil, preferably polymerized soil, more preferably polymerized grease soil, from cookware and tableware removal benefit is provided.

EXAMPLES

The following examples will further illustrate the present invention. The compositions are made by combining the listed ingredients in the listed proportions (weight % unless otherwise specified). The following Examples are meant to exemplify compositions used in a process according to the present invention but are not necessarily used to limit or otherwise define the scope of the present invention.

Abbreviations used in Examples

In the examples, the abbreviated component identifications have the following meanings:

| | |
|---|---|
| Carbonate | Anhydrous sodium carbonate |
| Silicate | Amorphous Sodium Silicate ($SiO_2$:$Na_2O$ ratio = 2.0) |
| Laponite clay | A 50/50 mixture of Laponite RDS ® and RD ® synthetic layered silicates available from Southern Clay Products, Inc. |
| $C_{16}AO$ | hexadecyl dimethyl amine oxide |
| $C_{12}EO_7$ | non-ionic $C_{12}EO_7$ surfactant |
| MEA | Monoethanolamine |
| XG | Xanthan Gum |
| PnB | Propylene glycol n-butyl ether commercially available as Dowanol PnB ® from Dow |
| EPh | Ethylene glycol phenyl ether commercially available as Dowanol EPh ® from Dow |
| TPnP | Tripropylene glycol n-propyl ether commercially available as Dowanol TPnP ® from Dow |
| TPM | Tripropylene glycol methyl ether commercially available as Dowanol TPM ® from Dow |
| TPnB | Tripropylene glycol n-butyl ether commercially available as Dowanol TPnB ® from Dow |
| DPnP | Dipropylene glycol n-propyl ether commercially available as Dowanol DPnP ® from Dow |
| DPnB | Dipropylene glycol n-butyl ether commercially available as Dowanol DPnB ® from Dow |
| DB | Diethylene glycol butyl ether |
| EPh (EO1-6) + DPM | Mixture of EPh with EO 1-6 and Dipropylene glycol methyl ether |

Examples 1 to 12 are composition according to the present invention. Examples 13 to 18 are comparative examples.

Examples 1 to 16 illustrate pre-treatment compositions used to facilitate the removal of cooked-on, baked-on and burnt-on food soils prior to the dishwashing process. The compositions of the examples are applied to a dishware load by spraying from a spray dispenser of trigger type. The load comprises different soils and different substrates: lasagna baked for 2 hours at 140° C. on Pyrex, lasagna cooked for 2 hours at 150° C. on stainless steel, potato and cheese cooked for 2 hours at 150° C. on stainless steel, egg yolk cooked for 2 hours at 150° C. on stainless steel and sausage cooked for 1 hour at 120° C. followed by 1 hour at 180° C. The dishware load is allowed to soak for 10 minutes in the compositions of the examples, then the dishware is rinsed under cold tap water. The dishware load is thereafter washed either manually or in an automatic dishwashing machine, for example in a Bosch 6032® dishwashing machine, at 55° C. without prewash, using a typical dishwashing detergent compositions containing, for example, alkalinity source, builders, enzymes, bleach, bleach catalyst, non-ionic surfactant, suds- suppresser, silver corrosion inhibitor, soil suspending polymers, etc. The dishware load treated with compositions of the examples and thereafter washed in the dishwashing machines present excellent removal of cooked-on, baked-on and burnt-on food soils.

| | Example | | | | | |
|---|---|---|---|---|---|---|
| | 1 | 2 | 3 | 4 | 5 | 6 |
| Pre-treatment composition | | | | | | |
| EPh | 5.00 | 5.00 | 5.00 | 5.00 | 5.00 | 2.50 |
| TPnP | 5.00 | — | — | 5.00 | — | 2.50 |
| TPM | — | 5.00 | — | — | — | — |
| TPnB | — | — | 5.00 | — | 5.0 | — |
| MEA | 5.00 | 5.00 | 5.00 | 5.00 | 5.00 | — |
| $C_{16}AO$ | 1.00 | 1.00 | 1.00 | 1.00 | 1.00 | — |
| Laponite clay | 2.00 | 2.00 | 2.00 | 0.6 | 0.6 | — |
| XG | 0.30 | 0.30 | 0.30 | — | — | — |
| Carbonate | 2.00 | 2.00 | 2.00 | 2.00 | 2.00 | — |
| Silicate | 0.30 | 0.30 | 0.30 | 0.30 | 0.30 | — |
| Na cumene sulfonate | 3.0 | 3.0 | 3.0 | 3.0 | 3.0 | — |
| Water | Balance | Balance | Balance | Balance | Balance | Balance |

| | Example | | | | | |
|---|---|---|---|---|---|---|
| | 7 | 8 | 9 | 10 | 11 | 12 |
| Pre-treatment composition | | | | | | |
| EPh | 7.00 | 4.00 | 1.00 | 5.0 | 5.0 | 5.0 |
| TPnP | 5.00 | — | — | — | — | — |
| TPM | — | 4.00 | — | — | — | — |
| TPnB | — | — | 3.00 | — | — | — |
| DPnP | — | — | — | 5.0 | 5.0 | — |
| DPnB | — | — | — | — | | 5.0 |
| MEA | — | 5.00 | 5.00 | 5.0 | 5.0 | 5.0 |
| $C_{16}AO$ | — | 1.00 | 1.00 | 1.0 | 1.0 | 1.0 |
| Laponite clay | — | 2.00 | 2.00 | 0.6 | 2.0 | 2.0 |
| XG | — | 0.30 | 0.30 | — | 0.3 | 0.3 |
| Carbonate | — | 2.00 | 2.00 | — | 2.0 | 2.0 |
| Silicate | — | 0.30 | 0.30 | — | 0.3 | 0.3 |
| Na cumene sulfonate | — | 1.00 | 1.00 | — | 3.5 | 3.5 |
| Water | Balance | Balance | Balance | Balance | Balance | Balance |

| | Example | | | |
|---|---|---|---|---|
| | 13 | 14 | 15 | 16 |
| Pre-treatment composition | | | | |
| EPh | — | 5.00 | 5.00 | 5.00 |
| TPnP | 5.00 | — | — | — |
| TPM | — | — | — | — |
| TPnB | — | — | — | — |
| PnB | — | — | 5.00 | — |
| DB | — | — | — | 5.00 |
| MEA | 5.00 | 5.00 | 5.00 | 5.00 |
| $C_{16}AO$ | 1.00 | 1.00 | 1.00 | 1.00 |
| Laponite clay | 2.00 | 2.00 | 2.00 | 2.00 |
| XG | 0.30 | 0.30 | 0.30 | 0.30 |
| Carbonate | 2.00 | 2.00 | 2.00 | 2.00 |
| Silicate | 0.30 | 0.30 | 0.30 | 0.30 |
| Na cumene sulfonate | 1.00 | 1.00 | 1.00 | 1.00 |
| Water | Balance | Balance | Balance | Balance |

-continued

| | Example | | | |
|---|---|---|---|---|
| | 17 | 18 | 19 | 20 |
| Pre-treatment composition | | | | |
| EPh | — | — | — | — |
| TPnP | — | — | — | — |
| TPM | — | — | — | — |
| TPnB | — | — | — | 2.50 |
| PnB | 5.00 | — | 3.00 | — |
| DB | 5.00 | — | — | — |
| EPh (EO1-6) + DPM | — | 10.00 | 3.70 | — |
| MEA | 5.00 | 5.00 | 3.00 | 5.00 |
| $C_{16}AO$ | 1.00 | 2.00 | — | 1.00 |
| $C_{12}EO_7$ | — | — | 2.00 | — |
| Laponite clay | 1.25 | 1.25 | 1.25 | 2.00 |
| XG | 0.15 | 0.15 | 0.15 | 0.30 |
| Carbonate | 2.00 | 2.00 | 2.00 | 2.00 |
| Silicate | 0.30 | 0.30 | 0.30 | 0.30 |
| Na cumene sulfonate | 1.00 | 1.00 | 1.00 | 1.00 |
| Water | Balance | Balance | Balance | Balance |

What is claimed is:

1. A hard surface cleaning composition comprising a solvent system, wherein said solvent system comprises: a mono-, di- or tri-ethylene glycol phenyl ether or a mixture thereof; and a di- or tri-propylene glycol alkyl ether having an alkyl chain containing from about 1 to about 5 carbon atoms or a mixture thereof; wherein said composition has a viscosity greater than about 1 Pa at 6 rpm lower than about 2 Pa at 30 rpm and lower than about 1 Pa at 60 rpm, as measured with a Brookfield cylinder viscometer using 10 ml sample and a spindle S-31.

2. A hard surface cleaning composition according to claim 1 wherein said composition is a sprayable composition.

3. A hard surface cleaning composition according to claim 1 wherein said mono-, di- or tri-ethylene glycol phenyl ether is according to the formula:

$$Ph—O—(C_2H_4O)_n—H$$

wherein n is an integer from about 1 to about 3.

4. A hard surface cleaning composition according to claim 1 wherein said mono-, di- or tri-ethylene glycol phenyl ether is a mono-ethylene glycol phenyl ether or a mixture of a mono- and a di-ethylene glycol phenyl ether.

5. A hard surface cleaning composition according to claim 1 wherein said di- or tripropylene glycol alkyl ether has an alkyl chain containing from about 1 to about 5 carbon atoms according to the formula:

$$R_1—O—(C_3H_6O)_n—H$$

wherein $R_1$ is an a branched or linear, saturated or unsaturated, substituted or unsubstituted alkyl chain having from about 1 to about 5 carbon atoms and n is an integer from about 2 to about 3.

6. A hard surface cleaning composition according to claim 1 wherein said di- or tripropylene glycol alkyl ether having an alkyl chain containing from about 1 to about 5 carbon atoms is a tripropylene glycol alkyl ether having an alkyl chain containing from about 1 to about 5 carbon atoms.

7. A hard surface cleaning composition according to claim 1 wherein said di- or tripropylene glycol alkyl ether having an alkyl chain containing from about 1 to about 5 carbon atoms is a tripropylene glycol n-propyl ether.

8. A hard surface cleaning composition according to claim 1 wherein said solvent system comprises a mono-ethylene glycol phenyl ether or a mixture of a mono- and a di-ethylene glycol phenyl ether and a tripropylene glycol n-propyl ether.

9. A hard surface cleaning composition according to claim 1 wherein said solvent system solvent system comprises said ethylene glycol phenyl ether and said di- or tri-propylene glycol alkyl ether at a weight ratio from about 99:1 to about 1:99.

10. A hard surface cleaning composition according to claim 1, wherein said composition solubilizes a polymerized grease soil such that the absorbance of said composition on said polymerized grease soil is measured at least about 0.1 after about 1.5 hours in contact with said polymerized grease soil.

11. A hard surface cleaning composition according to claim 1, wherein said composition has an equal or improved base odor compared to a product containing 10% of a 50:50 mixture of glycol n-butyl ether and propylene glycol n-butyl.

12. A hard surface cleaning composition according to claim 1, wherein said composition has a pH from about 11 to about 14, as measured in a 10% solution in distilled water.

13. A hard surface cleaning composition according to claim 1, wherein said composition comprises a soil swelling agent and a shear-thinning thickening system; wherein said composition has a viscosily from about 2 Pa to about 4 Pa at 6 rpm, from about 0.8 Pa to about 4 Pa at 30 rpm and from about 0.3 Pa to about 0.5 Pa at 60 rpm, as measured with a Brookfield cylinder viscometer using 10 ml sample and a spindle S-31; and wherein said composition when sprayed on a vertical stainless steel surface has a flow velocity less than about 1 cm/s.

14. A hard surface cleaning composition according to claim 1, wherein said composition has a reserve alkalinity of less than about 5.

15. A hard surface cleaning composition according to claim 1, wherein said composition further comprises from about 0.05 to about 10% of a surfactant selected from the group consisting of anionic, nonionic, amphoteric, zwitterionic, semi-polar surfactants, and mixtures thereof.

16. A hard surface cleaning composition according to claim 1, wherein said composition further comprises a soil swelling agent, wherein said soil swelling agent is an organoamine solvent selected from the group consisting of alkanolamines, alkylamines, alkyleneamines, and mixtures thereof.

17. A method of removing cooked-, baked- or burnt-on soils from cookware and tableware comprising treating said cookware/tableware with a hard surface cleaning composition comprising a solvent system, wherein said solvent system comprises: a mono-, di- or tri-ethylene glycol phenyl ether or a mixture thereof; and a di- or tri-propylene glycol alkyl ether having an alkyl chain containing from about 1 to about 5 carbon atoms or a mixture thereof; wherein said composition has a viscosity greater than about 1 Pa at 6 rpm, lower than about 2 Pa at 30 rpm and lower then about 1 Pa at 60 rpm, as measured with a Brookfield cylinder viscometer using 10 ml sample and a spindle S-31.

18. A method according to claim 17 comprising the step of pre-treating said cookware/tableware with said hard surface cleaning composition prior to manual or automatic dishwashing.

19. A method according to claim 17 comprising the step of spraying said hard surface cleaning composition onto cookware and tableware.

20. A hard surface cleaning product comprising said hard surface cleaning composition according to claim 1 and a spray dispenser therefore, wherein the spray droplets have an average equivalent geometric diameter from about 3 $\mu$m to about 10 $\mu$m, as measured using a particle size distribution analyzer.

* * * * *